US005970668A

United States Patent [19]

Arthurs et al.

[11] Patent Number: 5,970,668

[45] Date of Patent: Oct. 26, 1999

[54] CHIMNEY REINFORCEMENT DEVICE

[76] Inventors: Allan Arthurs; Stacy Arthurs, both of 1426 W. 105th St., Los Angeles, Calif. 90047-4501

[21] Appl. No.: 09/073,314

[22] Filed: May 4, 1998

[51] Int. Cl.[6] ..... E04C 5/00

[52] U.S. Cl. ..... 52/219; 52/244; 52/167.1; 52/514; 52/721.5; 52/741.3

[58] Field of Search ..... 52/219, 244, 167.1, 52/514, 721.5, 791.3

[56] References Cited

U.S. PATENT DOCUMENTS

| | | | |
|---|---|---|---|
| D. 285,411 | 9/1986 | Mahoney | D8/366 |
| 726,160 | 4/1903 | Harden | 52/219 |
| 3,281,997 | 11/1966 | Leonard | 52/219 |
| 3,388,881 | 6/1968 | Anderson | 248/74 |
| 3,464,174 | 9/1969 | Rosenberg | 52/218 |
| 3,602,468 | 8/1971 | Stone | 248/57 |
| 3,815,733 | 6/1974 | Roberts | 52/219 |
| 4,408,742 | 10/1983 | Korb | 248/74 |
| 5,444,952 | 8/1995 | Jackson | 52/219 |

*Primary Examiner*—Carl D. Friedman
*Assistant Examiner*—Bett Aubrey
*Attorney, Agent, or Firm*—Goldstein & Canino

[57] ABSTRACT

A chimney reinforcement device to be secured to a damaged or sound chimney comprising two front corner brackets and two rear corner brackets, which are bolted together to reinforce the upper portion of the chimney. Two wall mounting members are connected between the front corner brackets and the building so as to allow the front corner brackets to be firmly anchored to the building structural materials adjacent the chimney just below the roof line. The chimney reinforcement device further comprises two inclined arm member connected between the rear corner brackets and the roof such that the corner brackets are firmly anchored to the roof structure adjacent to the chimney. When the chimney reinforcement device is properly secured to a chimney, the chimney reinforcement device adds strength to the existing framework of the chimney and thereby prevents severe cracking or falling thereof during an earthquake.

5 Claims, 4 Drawing Sheets

CHIMNEY REINFORCEMENT DEVICE

BACKGROUND OF THE INVENTION

This invention relates to a chimney reinforcement device. More particularly, the invention relates to a device which may be secured to a damaged or sound chimney for strengthening the existing framework of the chimney.

Various references uncovered in the prior art provide devices for reducing the chance of a brick chimney toppling during an earthquake. For example, U.S. Pat. No. 5,444,952 to Jackson discloses a chimney reinforcing device comprising four angle iron extending on the exterior corners of the chimney that are tied together by one or more cables for increasing the resistance thereof to destruction during an earthquake. Likewise, U.S. Pat. No. 3,602,468 to Stone discloses a roof support assembly for securing a prefabricated metal chimney to a sloped roof.

Despite all these chimney reinforcing devices, there is still a further need to provide an improved chimney reinforcement device. Such a chimney reinforcement device should be capable of being adjusted to accommodate chimneys of various sizes. Moreover, such a chimney reinforcement device should be capable of sufficiently strengthening the existing framework of a damaged or old chimney by securing rigid brackets thereabout and subsequently anchoring them to the building structural materials underneath the roof covering.

While these units mentioned above may be suitable for the particular purpose employed, or for general use, they would not be as suitable for the purposes of the present invention as disclosed hereafter.

SUMMARY OF THE INVENTION

It is an object of the invention to provide a chimney reinforcement device which can be readily secured about an existing chimney.

It is another object of the invention to provide a chimney reinforcement device which can be easily adjusted to accommodate chimneys of various sizes.

It is yet another object of the invention to provide a chimney reinforcement device which is capable of sufficiently strengthening the existing framework of a chimney so as to allow the chimney to resist a wide range of forces that may be experienced during earthquakes, tornadoes and the like.

The invention is a chimney reinforcement device to be secured to a damaged or sound chimney comprising two front corner brackets and two rear corner brackets, which are bolted together to reinforce the upper portion of the chimney. Two wall mounting members are connected between the front corner brackets and the building so as to allow the front corner brackets to be firmly anchored to the building structural materials adjacent the chimney just below the roof line. The chimney reinforcement device further comprises two inclined arm members connected between the rear corner brackets and the roof such that the corner brackets are firmly anchored to the roof structure adjacent to the chimney. When the chimney reinforcement device is properly secured to a chimney, the chimney reinforcement device adds strength to the existing framework of the chimney and thereby prevents severe cracking or falling thereof during an earthquake.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
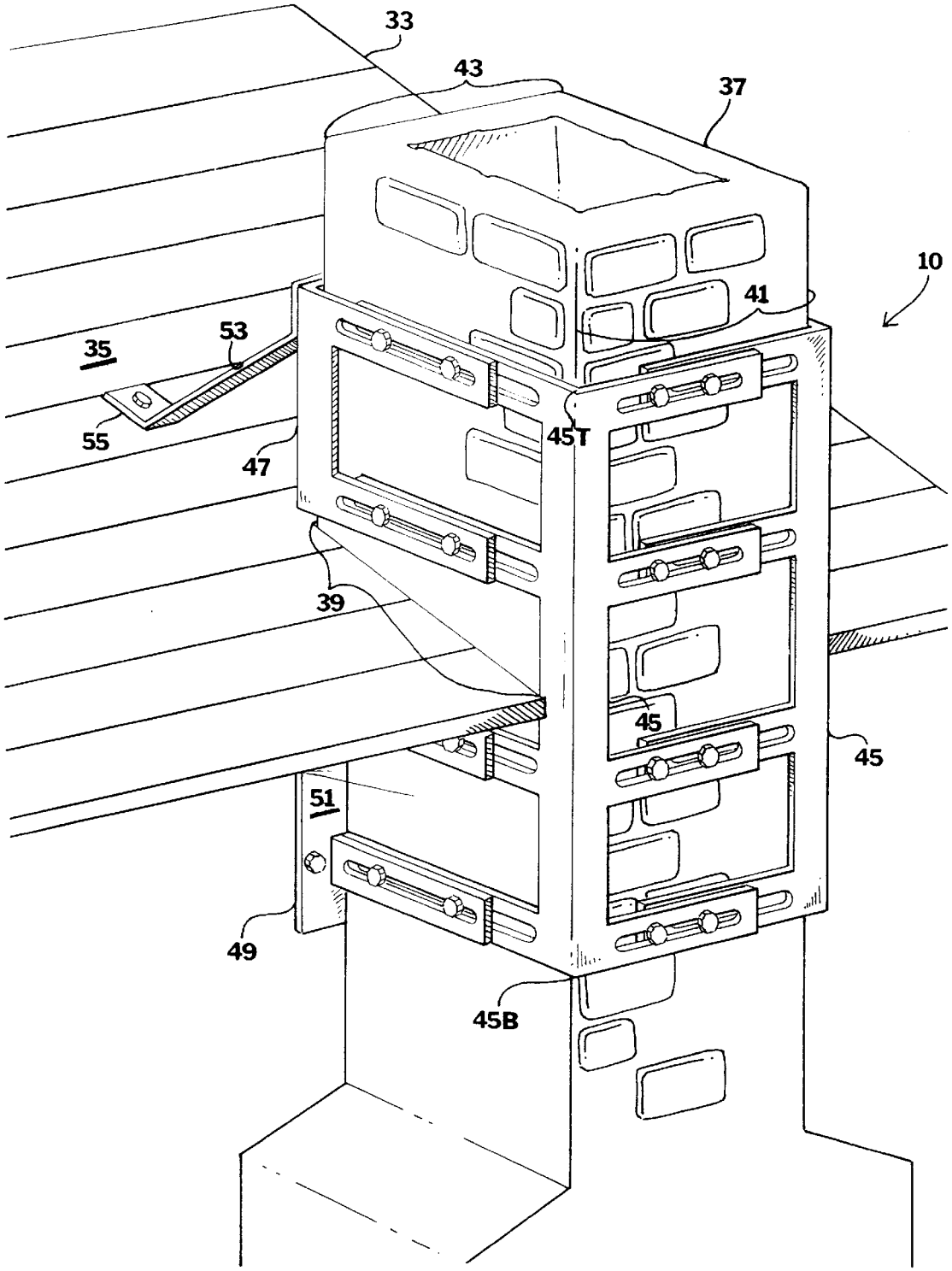
FIG. 1 is a diagrammatic perspective view of a chimney having a chimney reinforcement device of the present invention secured thereabout.

FIG. 1 illustrates a preferred embodiment of a chimney reinforcement device 10 in accordance with the principles of the present invention. For a better understanding of the present invention, a building 33 is illustrated having a roof structure 35, a chimney 37 supported in an elevated position that extends above the roof line 39, wherein the chimney 37 includes two front external corners 41 and two rear external corners 43. As will be seen in following paragraphs, the chimney reinforcement device 10 of the present invention is designed to strengthen old or damaged chimneys and thereby prevents severe cracking and collapsing thereof. The chimney reinforcement device 10 can be constructed of steel or any other suitable rigid durable material such as high strength aluminum.

The chimney reinforcement device 10 comprises two front corner brackets 45 adapted to engage the front external corners 41 of the chimney 37. Each front corner bracket 45 includes a vertical column having a top end 45T and a bottom end 45B, which is bent at about 90 degrees so as to allow the front corner brackets 45 to lie tightly against the front external corners 41 of the chimney 37. The front corner brackets 45 further includes a plurality of horizontally extending arms formed along the vertical column thereof, wherein each of the horizontally extending arms contains an elongated slot for the passage of affixing fasteners.

The chimney reinforcement device 10 further comprises two rear corner brackets 47 which are similar to the front corner brackets 45 except the rear corner brackets are shorter to engage the rear external corners 43 of the chimney 37 above the roof line 39. Each rear corner bracket 47 includes a vertical column, length of which is selected so as to allow one end thereof to be horizontally aligned with the top end 45T of the front corner brackets 45 when the other end thereof is placed adjacent the roof line 39. A plurality of horizontally extending arms are formed along the vertical column thereof, which have elongated slots formed therein for passage of affixing fasteners. Although in a preferred embodiment, the corner brackets 45 and 47 have vertical columns which are adapted for chimney's external corners 41 and 43 having 90 degree angles, it should be noted that the shape of the vertical column may be modified to suit a chimney with irregular corner angles.

Figure 2:
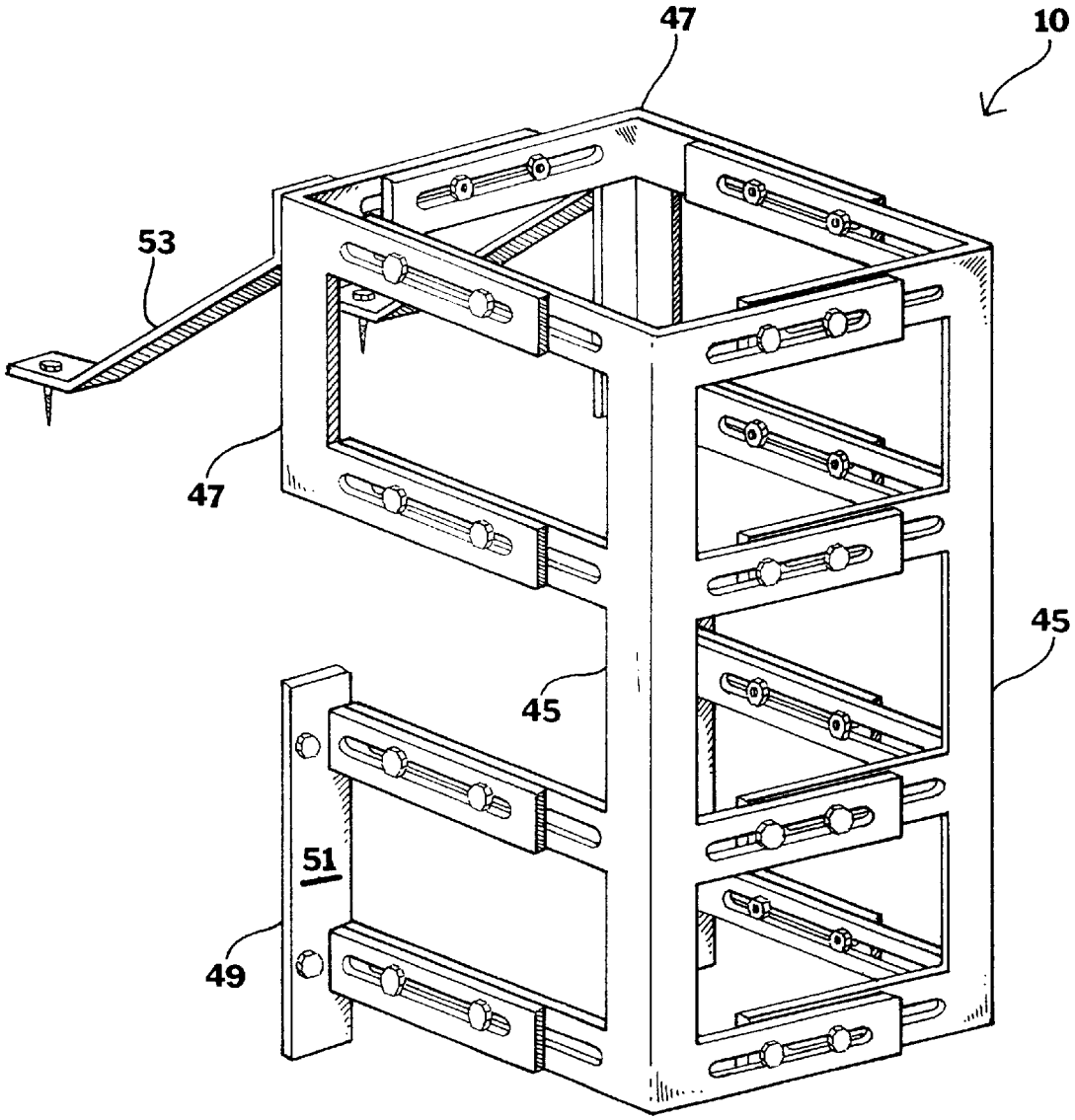
FIG. 2 is a diagrammatic perspective view of a preferred embodiment of the present invention.
Figure 3:
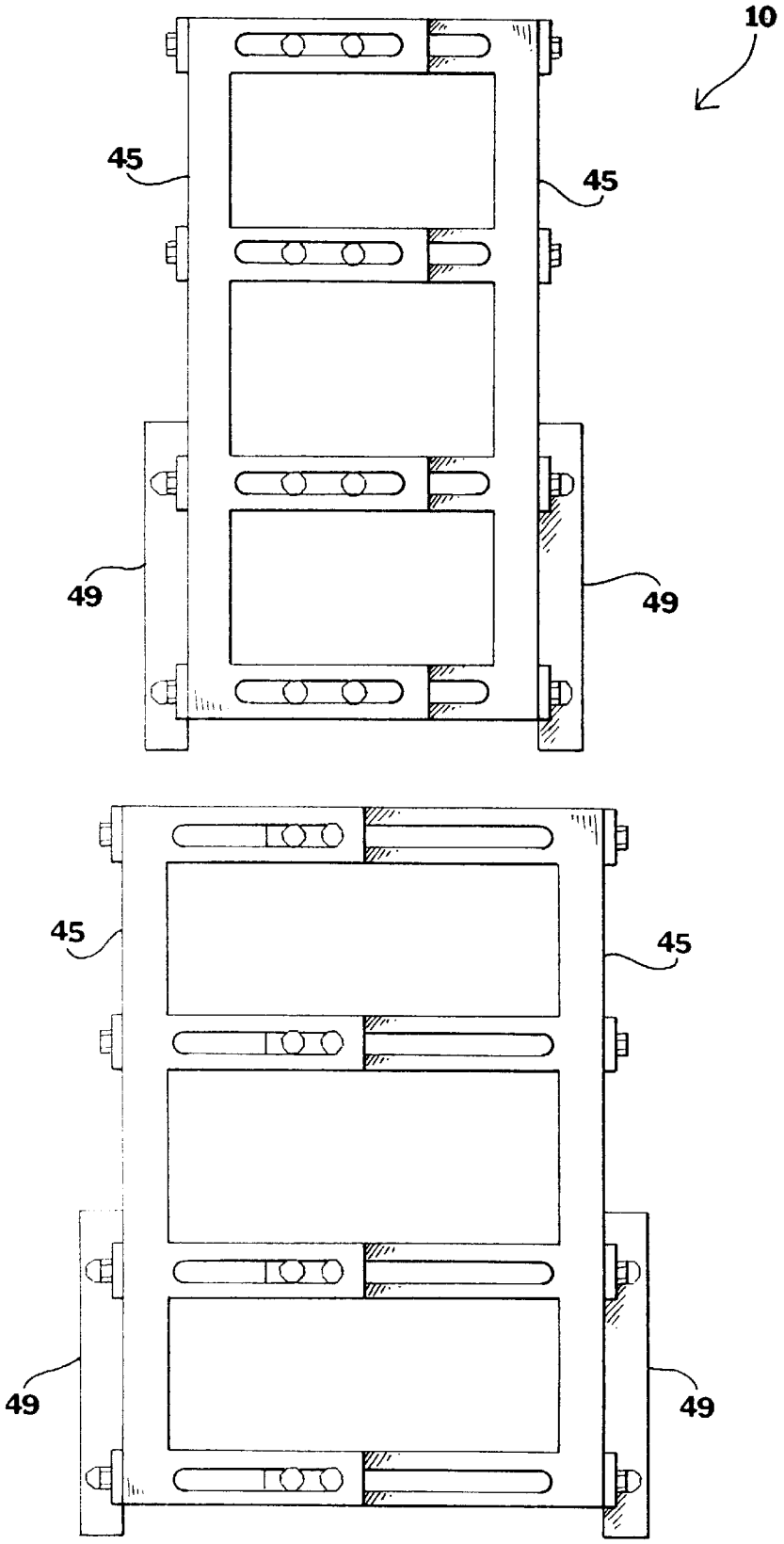
FIG. 3 is a front elevational view of the present invention.
Figure 4:
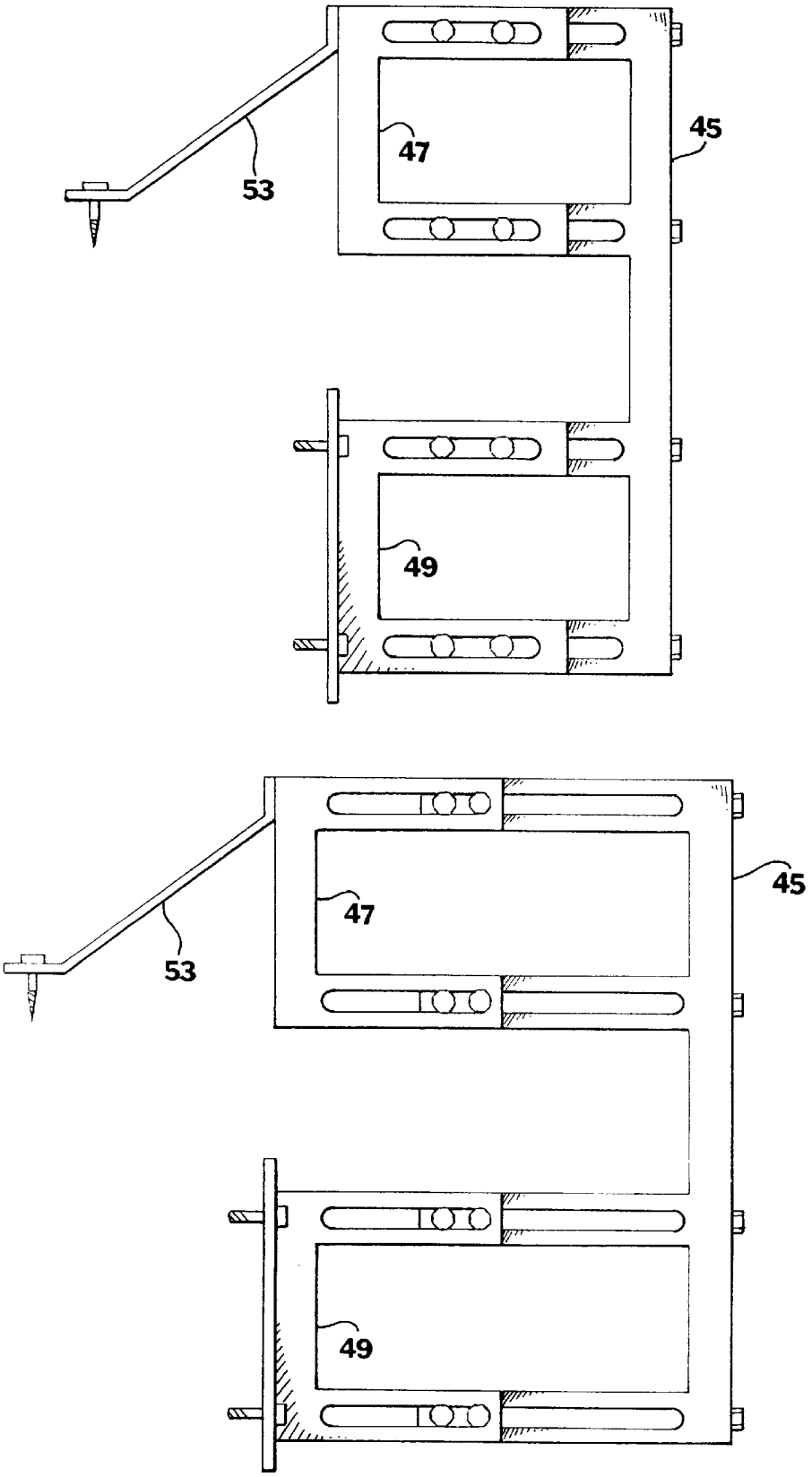
FIG. 4 is a side elevational view of the present invention.

FIGS. 2, 3, and 4 illustrate a pair of wall mounting members 49 having a flat piece 51 adapted to be secured to the building structural materials adjacent the chimney 37 beneath the roof line 39. The flat piece 51 has one or more openings for receiving fasteners and is vertically mounted to the building by affixing long hardened screws through the openings therein, through wall covering and into the building structural materials. Each wall mounting member 49 further includes one or more horizontally extending arms welded having elongated slots formed therein for passage of affixing fasteners. The horizontally extending arms of the wall mounted members 49 are positioned along the flat pieces 51 such that the elongated slots formed therein align with the elongated slots of the front corner brackets 45.

FIGS. 2 and 4 illustrate inclined arm members 53 connected between the rear corner brackets 47 and the roof structure 35 adjacent to the chimney 37. The inclined arm members 53 are designed to support the corner brackets 45 and 47 and the chimney 37 contained therein so as to reduce the chance of the chimney 37 cracking and collapsing during an earthquake and the like. The angle and length of the inclined arm member 53 is selected so as to allow the inclined arm member 53 to extend between the rear corner bracket 47 and a contact point 55 along the roof covering where sturdy building structural materials exist therebelow. The lower ends of the inclined arm members 53 include openings for receiving fasteners and are anchored to the roof structure 35 by affixing long hardened screws through the opening therein, through the roof covering and into the building structural materials.

To secure the chimney reinforcement device 10 about a chimney 37, the wall mounting members 49 are firmly anchored to the external side wall of the building 33 adjacent to the chimney 37 beneath the roof line 39 by affixing fasteners through the openings formed in the flat piece 51 thereof, through the wall covering, and into the building structural materials. The front corner brackets 45 are secured to the wall mounting members 49 by affixing one or more fasteners though the elongated slots of both the wall mounting members 49 and the front corner brackets 45 such that the front corner brackets 45 are tightly engaged with the chimney. As shown in FIG. 4, the front corner bracket 45 with respect to the wall mounting member 49 can be expanded wherein the front corner bracket 45 is moved in the direction away from the chimney 37 and retracted wherein the front corner brackets 45 is moved in the direction toward the chimney 37. In this manner, the chimney reinforcement device 10 can be easily adjusted to accommodate chimneys of various sizes.

The front corner brackets 45 are secured to each other by affixing fasteners through the elongated slots of both of the front corner brackets 45. As shown the FIG. 3, the front corner brackets 45 can be expanded and retracted with respect to each other so as to allow them to tightly embrace the surfaces of the chimney 37. In the similar manner, the rear corner brackets 47 are secured to the front corner brackets 45 to reinforce the upper portion of the chimney 37. Finally, the inclined arm members 53 are connected to the rear corner brackets 47 at one end and anchored to underlying roof structural materials 35 at the other end. When the device of the present invention is properly secured about a chimney, the chimney reinforcement device 10 adds strength to the existing framework of the chimney and thereby reduces the chance of cracking or falling thereof during earthquakes, tornadoes, and the like.

While the embodiments of the present invention are disclosed in relation to chimneys that are situated along an external wall of a dwelling, it will be appreciated by those skilled in the art that the chimney reinforcement device 10 disclosed herein may be utilized in connection with other types of chimneys. Including those chimneys that are situated within the field of a roof, meaning that the entire perimeter of the chimney is surrounded by roof structures. In such cases, only the top portion of the chimney reinforcement device 10 is necessary and should be manufactured.

Many specific details contained in the above description merely illustrate some preferred embodiments and should not be construed as a limitation on the scope of the invention. Many other variations are possible.

What is claimed is:

1. A chimney reinforcement device for strengthening a chimney having front external corners, rear external corners, and an upper portion thereof extending above a roof line, said chimney reinforcement device comprising:

a) two front corner brackets adapted to engage said front external corners of said chimney, said front corner brackets secured to each other such that the front corner brackets tightly embrace said front external corners of the chimney;

b) two rear corner brackets adapted to engage said rear external corners of said chimney, said rear corner brackets secured to each other such that the rear corner brackets tightly embrace said rear external corners of the chimney, said rear corner brackets secured to said front corner brackets to reinforce said upper portion of the chimney;

c) two wall mounting members adapted to be secured to building structural materials adjacent said chimney beneath said roof line, said front corner brackets securely anchored to said building structural materials by means of said wall mounting members; and d) two inclined arm members connected between said rear corner brackets and adapted to be connected to said roof adjacent to said chimney for securely anchoring said chimney reinforcement device and said chimney contained therein to said structural materials.

2. The chimney reinforcement device as recited in claim 1, wherein each of the front corner brackets further comprises a vertical column having a top end and a bottom end, said vertical column being bent to permit tight engagement with the front external corners of the chimney, and a plurality of horizontally extending arms formed along said vertical column, each of said horizontally extending arms having an elongated slot for passage of affixing fasteners.

3. The chimney reinforcement device as recited in claim 2, wherein each of the rear corner brackets further comprises a vertical column being bent to permit tight engagement with the rear external corners of the chimney, the length of said vertical column is selected so as to allow one end thereof to be horizontally aligned with the top end of the front corner brackets when the other end thereof is positioned adjacent the roof line, and a plurality of horizontally extending arms formed along the vertical column thereof, each of said horizontally extending arms having an elongated slot for passage of affixing fasteners.

4. The chimney reinforcement device as recited in claim 3, wherein each of the wall mounting members further comprise a flat piece adapted to be secured to said building structural materials adjacent the chimney beneath the roof line, said flat piece having one or more openings for receiving fasteners, and at least one horizontally extending arm having an elongated slot, said horizontally extending arm welded to said flat piece such that said elongated slot thereof align with the elongated slots of the front corner brackets.

5. A method of strengthening a chimney having front external corners, rear external corners, and an upper portion thereof extending above a roof line, with a chimney reinforcement device comprising two front corner brackets, two rear corner brackets, two wall mounting brackets, and two inclined arm members, said method comprising steps of:

a) securing said front corner brackets to each other such that said front corner brackets tightly embrace said front external corners of said chimney;

b) securing said rear corner brackets to each other such that said rear corner brackets tightly embrace said rear external corners of said chimney;

c) securing said rear corner brackets to said front corner brackets to reinforce said upper portion of said chimney;

d) securing said wall mounting members to building structural materials adjacent said chimney beneath said roof line;

e) anchoring said front corner brackets to said building structural materials by securing said front corner brackets to said wall mounting members; and f) anchoring said front and rear corner brackets to a roof adjacent to said chimney by connecting said inclined arm members between said rear corner brackets and structural materials.

* * * * *